US005930837A

United States Patent [19]

Anvar

[11] Patent Number: 5,930,837

[45] Date of Patent: Aug. 3, 1999

[54] DISPOSABLE BIB

[76] Inventor: Bijan Anvar, 953 W. Boston Post Rd. Apt. #3-0, Mamaroneck, N.Y. 10543

[21] Appl. No.: 09/137,250

[22] Filed: Aug. 20, 1998

[51] Int. Cl.[6] ..... A41B 13/00; A41B 13/10

[52] U.S. Cl. ..... 2/49.1; 2/52

[58] Field of Search ..... 2/49.1, 52, 49.4, 2/49.5, 48, 49.2, 49.3, 46, 50, 51

[56] References Cited

U.S. PATENT DOCUMENTS

| | | |
|---|---|---|
| 2,425,961 | 8/1947 | Shattuck . |
| 2,782,420 | 2/1957 | Barager . |
| 3,001,646 | 9/1961 | Cooper . |
| 3,329,969 | 7/1967 | Farber et al. . |
| 3,793,644 | 2/1974 | Kellner . |
| 3,999,221 | 12/1976 | Hannigan . |
| 4,186,443 | 2/1980 | Britzman . |
| 4,233,688 | 11/1980 | Hjerl . |
| 4,423,523 | 1/1984 | Bodner et al. . |
| 4,475,250 | 10/1984 | Savin et al. . |
| 4,646,364 | 3/1987 | O'Leary . |
| 4,884,299 | 12/1989 | Rose . |
| 5,056,159 | 10/1991 | Zemke . |
| 5,491,844 | 2/1996 | Kehl et al. . |
| 5,809,568 | 9/1998 | Morris-Jones . |

FOREIGN PATENT DOCUMENTS

| | | |
|---|---|---|
| WO 86/05076 | 9/1986 | WIPO . |

*Primary Examiner*—John J. Calvert
*Assistant Examiner*—Shirra L. Jenkins
*Attorney, Agent, or Firm*—Brown, Martin, Haller & McClain, LLP

[57] ABSTRACT

A disposable bib is formed from a sheet of absorbent material having a first tear line of perforations extending from a first point on an upper edge of the sheet around a generally arcuate path back to a second point on the upper edge. A second tear line is spaced downwardly from the first line and following a generally matching path to define an arcuate band between the first and second lines. The second tear line does not extend to the upper edge of the sheet. The sheet is torn along the first tear line to form a cut-out for fitting around a wearer's neck, and along the second tear line to form a band attached to the sheet. The band can be folded upwardly and engaged over the back of the wearer's head, so that the sheet or bib is secured in position without needing any separate attachment devices.

8 Claims, 1 Drawing Sheet

DISPOSABLE BIB

BACKGROUND OF THE INVENTION

The present invention relates generally to bibs for providing a protective covering to the lower neck and chest area, and is particularly concerned with a disposable bib for dental or other medical uses.

Absorbent paper bibs are generally used in the dental field to protect the chest and part of the neck of the dental patient during dental procedures. Such bibs are generally secured around the neck by metal chains with clips at each end, which are passed around the back of the patient's neck and then clipped at each end to the bib. After a procedure is complete, the paper bib is discarded, but the metal chain is re-used and must therefore be cleaned and sterilized. U.S. Pat. No. 5,491,844 of Kehl et al. describes a dental bib which is secured to the patient's clothing by means of a strip of adhesive. This avoids the need for a chain which must be cleaned for re-use, but there are some disadvantages in using adhesive, since it may soil or damage the patient's clothing on removal of the bib.

SUMMARY OF THE INVENTION

It is an object of the present invention to provide a new and improved disposable bib which is particularly suitable for use as a dental or medical bib where sterile conditions are important.

According to the present invention, a bib is provided which comprises a sheet of absorbent material having an upper edge, a first tear line of perforations extending from a first point on the upper edge in an at least partially arcuate first path to a second point on said upper edge spaced from the first point to define a cut-out area for fitting around the front of a wearer's neck, a second tear line of perforations extending in a second path spaced outwardly from the first path to define an arcuate band of substantially constant width between the first and second tear lines, the second tear line having first and second ends spaced from the upper edge of the sheet, such that a portion of the sheet bounded by the upper edge and first tear line can be removed by tearing along the first tear line to form the cut-out area, and a strap can be formed between the first and second tear lines by tearing along the second tear line, whereby the sheet can be secured to the wearer's chest by engaging the strap over the back of the wearer's neck.

The sheet is preferably of absorbent paper or cotton material which may or may not have a rear coating of plastic or the like which is moisture-proof. In a preferred embodiment, the sheet is of rectangular shape, although other shapes such as round, oval, or the like may be used. The sheet can readily be prepared for use as a bib simply by tearing along the first tear line to remove a portion of the sheet to define an arcuate cut-out region, and then tearing along the second tear line to form a securing strap or loop. The strap portion is then bent upwardly to define a generally circular opening through which the patient's head may be inserted. After use, the entire bib is removed and discarded, avoiding the need for clips, chains, or any other form of attachment device. The benefit of this arrangement is that it is completely discardable after use. Clips and other separate, re-usable attachment devices collect bacteria and are usually not autoclavable, giving rise to the risk of potential cross contamination by bacteria and viruses. The bib of this invention avoids this risk and therefore creates more sanitary conditions for performing dental procedures.

The bib will be provided in various dimensions for use by different size individuals, and for use in different procedures such as medical, dental, cosmetic, and therapeutic procedures and the like.

BRIEF DESCRIPTION OF THE DRAWINGS

The present invention will be better understood from the following detailed description of a preferred embodiment of the invention, taken in conjunction with the accompanying drawings in which like reference numerals refer to parts and in which.

DESCRIPTION OF THE PREFERRED EMBODIMENT

Figure 1:
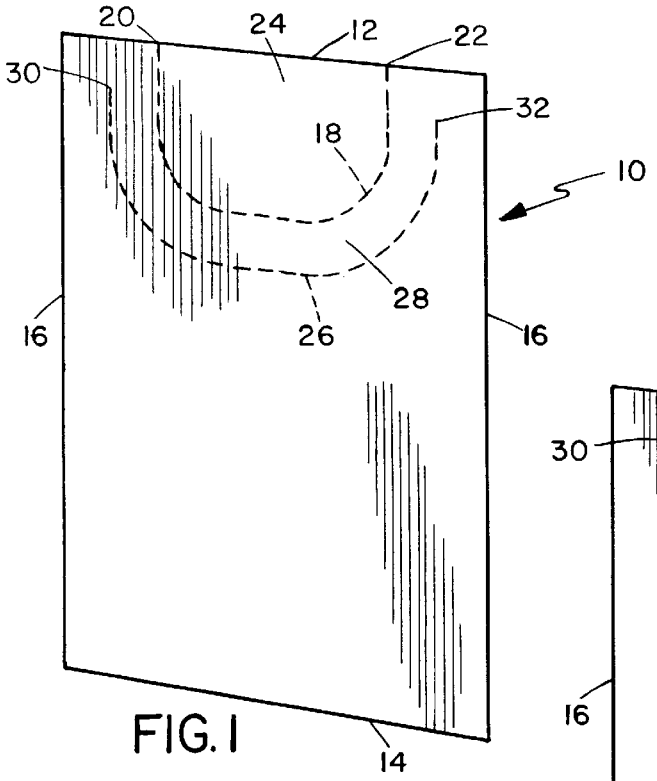
FIG. 1 illustrates a disposable bib according to a preferred embodiment of the invention.
Figure 2:
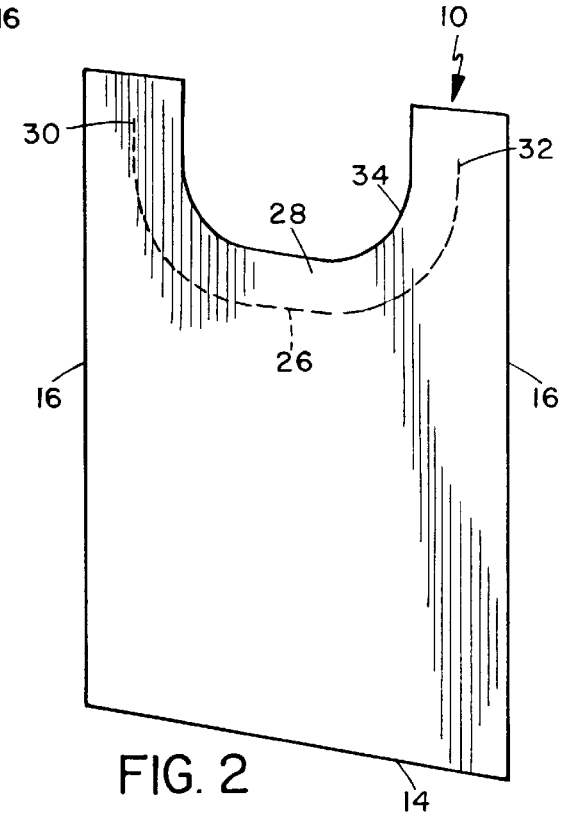
FIG. 2 is a similar view with the initial portion removed.
Figure 3:
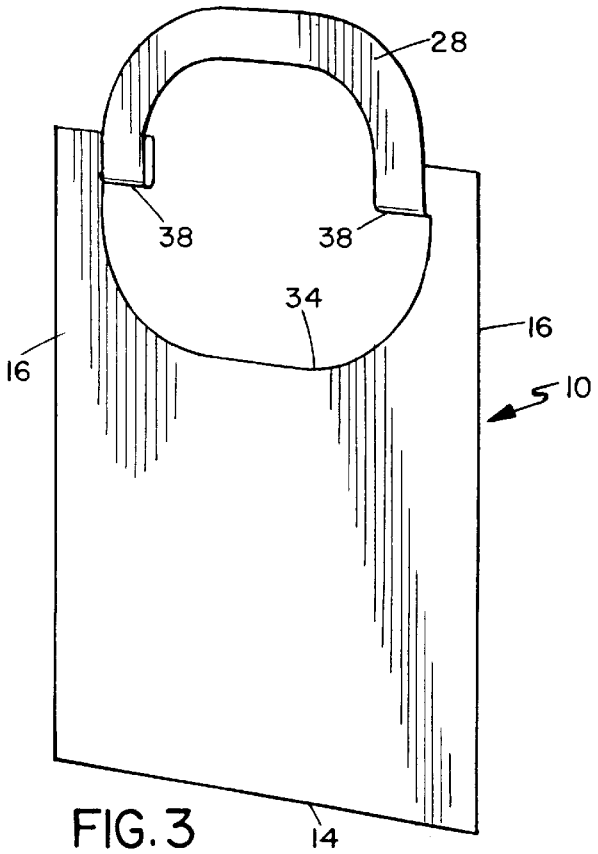
FIG. 3 is a similar view with the neck band separated and opened.
Figure 4:
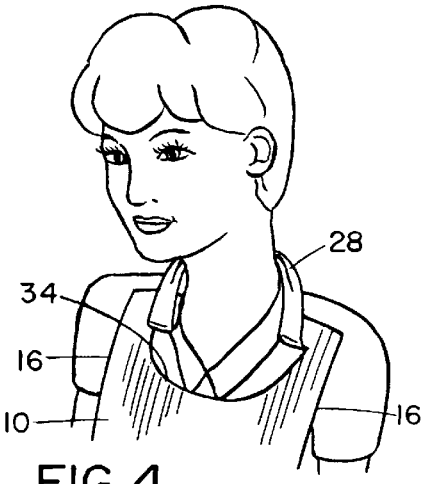
FIG. 4 illustrates the bib in use.

FIGS. 1 to 4 illustrate a disposable bib 10 according to a preferred embodiment of the present invention, with FIG. 1 illustrating the bib as manufactured, prior to use, FIGS. 2 and 3 illustrating steps in preparation of the bib for use, and FIG. 4 illustrating the bib in use, placed around a person's neck. The bib is primarily intended for use as a protective cover for a patient's chest and neck during dental procedures, but may also be used in any other application where protection of the chest and lower neck area from soiling is desired, such as medical, cosmetic, and therapeutic procedures, or for infants and young children when eating.

Bib 10 comprises a generally rectangular sheet of absorbent and water proof material, such as absorbent paper or cotton with a plastic backing layer or coating. The material may be identical to that currently used for dental bibs, for example. The sheet has an upper edge 12, a lower edge 14, and opposite side edges 16. A first tear line 18 of perforations extends in a generally arched path from a first end 20 on the upper edge 12 spaced on one side of the center line, and a second end 22 on the edge 12 spaced outwardly to the opposite side of the center line of the bib upper edge. The first tear line 18 defines a removable inner portion 24 of the sheet.

A second tear line 26 of perforations is spaced below the first line 18 and extends along a path of substantially matching, arched shape to define an arcuate band 28 between the first and second tear lines. The second tear line terminates short of the upper edge 12 of the sheet, and has ends 30, 32 spaced from edge 12.

The dimensions of the rectangular sheet as illustrated in FIG. 1 will be dependent on the size of the area on the patient or user to be protected. Thus, the bib will be provided in a range of different sizes for use by individuals of different sizes, shapes, and ages, and also for use in different applications. The bib will be provided in a range of widths from around 8 inches to inches, and a range of lengths from about 12 inches to 84 inches.

Preparation of a bib sheet as illustrated in FIG. 1 for use as a bib as illustrated in FIG. 4 will now be described, with reference to FIGS. 2 and 3. By tearing along the first tear line 18, the central portion 24 enclosed by the tear line can be removed and discarded, leaving an arcuate cut-out 34 as illustrated in FIG. 2. The sheet is then torn along the second tear line 26 to define a separate band 28. This band is then folded upwardly along fold lines 38 on each side of cut-out 34, to form a continuous neck opening as illustrated in FIG. 3. The neck opening is then placed over the patient's head with the remainder of the bib to the front, so that the bib is held in position as indicated in FIG. 4.

After completion of a dental procedure, for example, the entire bib can be removed and discarded, avoiding the need to re-use any part with the resultant infection risk. The bibs are initially manufactured as simple, flat, rectangular or square sheets with two spaced lines of perforations to define the removable portion 24 and the band 28. The bibs are therefore inexpensive to manufacture, and can be readily prepared for use simply by tearing along the first tear line 18 and then along the second tear line 26 to create the loop. This arrangement totally eliminates the need for clips or any other form of attachment device, which would have to be cleaned after use and may create a non-sterile environment for subsequent patients. The bib also avoids the use of adhesive to attach a disposable bib to clothing, which potentially soils or damages delicate fabric. This bib is inexpensive, easy to use, and creates more sanitary conditions.

Although a preferred embodiment of the invention has been described above by way of example only, it will be understood by those skilled in the field that modifications may be made to the disclosed embodiment without departing from the scope of the invention, which is defined by the appended claims.

I claim:

1. A bib, comprising:

a sheet of absorbent material having an upper peripheral edge;

a first tear line of perforations extending from a first point on said upper edge along an at least partially arcuate path back to a second point on said upper edge spaced from said first point to define a removable portion of said sheet for forming a cut-out area for fitting around the front of a wearer's neck;

a second tear line of perforations extending along a second path spaced downwardly from said first tear line and substantially matching the path of said first tear line to define an arcuate band between said first and second tear lines; and the second tear line having opposite ends spaced from said upper edge;

whereby tearing said sheet along said first tear line removes said removable portion and tearing along said second tear line creates said arcuate band, and the bib can be secured to a wearer's chest by engaging the band over the back of the wearer's neck.

2. The bib as claimed in claim 1, wherein the sheet is of generally rectangular shape.

3. The bib as claimed in claim 1, wherein the sheet has a width in the range from 8 inches to 48 inches.

4. The bib as claimed in claim 3, wherein the sheet has a length in the range from 12 inches to 84 inches.

5. The bib as claimed in claim 1, wherein the sheet has a waterproof coating on one side.

6. The bib as claimed in claim 1, wherein the sheet is of absorbent paper.

7. The bib as claimed in claim 6, wherein the paper sheet has a plastic backing layer.

8. A method of securing a disposable bib around a wearer's neck, comprising the steps of:

taking a sheet of absorbent paper material and tearing the sheet along a first tear line to remove a portion of the sheet at an upper end of the sheet to create an arcuate cut-out;

tearing the sheet along a second tear line spaced downwardly from the first tear line and following the same general path as the first tear line to create an arcuate band attached to the sheet;

bending the band upwardly around a fold line on each side of the arcuate cut-out to create an opening defined by the edge of the cut-out and the band;

placing the opening over a wearer's head and pulling the sheet down over the wearer's head and neck to position the band at the back of the wearer's neck and the remainder of the sheet across the front of the wearer's chest; and after use, removing and discarding the sheet.

* * * * *

UNITED STATES PATENT AND TRADEMARK OFFICE

CERTIFICATE OF CORRECTION

PATENT NO. :5,930,837

DATED :August 3, 1999

INVENTOR(S) :Bijan Anvar

It is certified that error appears in the above-indentified patent and that said Letters Patent is hereby corrected as shown below:

Column 2, line 56, after "around 8 inches to" insert --48--

Signed and Sealed this

Twentieth Day of March, 2001

Nicholas P. Godici

*Attest:*

NICHOLAS P. GODICI

*Attesting Officer*

*Acting Director of the United States Patent and Trademark Office*